United States Patent [19]

Abe

[11] 4,072,156

[45] Feb. 7, 1978

[54] COIN SORTING DEVICE

[75] Inventor: Masahiro Abe, Himeji, Japan

[73] Assignee: Glory Kogyo Kabushiki Kaisha, Japan

[21] Appl. No.: 707,003

[22] Filed: July 20, 1976

[30] Foreign Application Priority Data

| | | |
|---|---|---|
| July 25, 1975 | Japan | 50-90164 |
| July 31, 1975 | Japan | 50-93454 |
| Apr. 15, 1976 | Japan | 51-42948 |

[51] Int. Cl.[2] ..... G07D 3/02

[52] U.S. Cl. ..... 133/3 F; 133/3 H; 198/456; 198/725; 209/85

[58] Field of Search ..... 133/3 R, 3 D, 3 E, 3 F, 133/3 H, 8 R, 8 E; 209/85, 83, 97–99; 198/456, 725, 735

[56] References Cited

U.S. PATENT DOCUMENTS

| | | | |
|---|---|---|---|
| 1,038,293 | 9/1912 | Chiger | 133/3 F |
| 2,101,513 | 12/1937 | Samuelsen et al. | 133/3 E |
| 3,174,632 | 3/1965 | Eynon | 198/456 X |
| 3,187,759 | 6/1965 | Rausing | 133/3 R |
| 3,347,249 | 10/1967 | Becker | 133/8 R |
| 3,396,737 | 8/1968 | Picollo | 133/8 R X |
| 3,621,854 | 11/1971 | Redman | 133/3 H |

FOREIGN PATENT DOCUMENTS

| | | | |
|---|---|---|---|
| 2,311,529 | 3/1973 | Germany | 133/3 H |

*Primary Examiner*—Drayton E. Hoffman
*Assistant Examiner*—Fred A. Silverberg
*Attorney, Agent, or Firm*—Wenderoth, Lind & Ponack

[57] ABSTRACT

A coin sorting device has a coin passage with a floor and a lateral perimeter defining structure on one lateral side (or each of the lateral sides) of the passage, the floor having holes for successively larger coins disposed successively along the passage at positions respectively contiguous to the perimeter defining structure, and the lower span of an endless propelling belt for pressing on the upper faces of the coins and propelling the same is caused by the varying of the travel path of the coins by the perimeter defining structure to be elastically twisted or laterally deflected at parts thereof where the travel path is thus varied and thereby to acquire a reactive restoring force which urges the coins against the corresponding parts of the perimeter defining structure and thereby causes them to be accurately alined in a lateral direction for dropping into their respectively correct sorting holes.

7 Claims, 17 Drawing Figures

COIN SORTING DEVICE

BACKGROUND OF THE INVENTION

This invention relates generally to classification or sorting apparatuses for articles such as coins and more particularly to a sorting device for selectively separating, by the kind of coin, coins of different diameters of two or more kinds.

Heretofore, in a device for sorting coins of different diameters of several kinds into groups each of the same kind, sorting holes having different widths for receiving coins according to the kind of coin are ordinarily arranged in a coin passage in sequence from a hole for the smallest diameter to a hole for the largest diameter. A mixture of coins of different kinds are fed into this passage and are caused to drop in sequence through the respectively corresponding holes thereby to be sorted by kind.

In a sorting device of the above described arrangement, however, during the feeding of the coins, the coins will not drop through their respective sorting holes unless they travel accurately in centerline alinement with these holes. For this reason, there has been the possiblity in a sorting device of this character of coins passing by the sorting holes through which they should drop, thereby giving rise to erroneous sorting and a lowering of the sorting accuracy. The same problem has been present also in sorting devices of the type wherein only coins of a specific kind are passed, and coins of other kinds are discharged at intermediate points of their travel.

Therefore, one expedient resorted to heretofore for assuring that coins being sorted will drop positively into their proper holes even when the coins are fed along the coin passage with some lateral misalinement or offset from the hole centerline has been to lengthen the sorting holes to lengthen the time of passing of the coins over the holes and thereby to facilitate the dropping of the coins. When this is done, however, the total length of the coin passage of the apparatus becomes long, and the entire apparatus tends to become large.

On one hand, there are coin sorting devices of a type wherein the coin passage is laterally inclined to cause the coins to travel through the passage in a state in which they are constantly in contact with one side wall of the passage and thereby to assure positive dropping of the coins into the proper holes. In this device, however, the friction of the coins relative to the side wall surface of the coin passage increases, whereby slippage readily occurs between an endless propelling belt propelling the coins and the coins. As a consequence, positive propelling of the coins is difficult, and, at the same time, the wear of the coins becomes a serious problem.

Furthermore, as mentioned hereinabove, there is a sorting device having a coin feeding passage for passing only coins of one specific kind, for example, and feeding these coins to the packaging of section of a coin packaging machine. This coin feeding passage also has problems similar to those described above in the sorting of small-diameter coins of different kinds througb sorting holes for discharging small-diameter coins provided in the coin passage.

More specifically, in the case of a conventional coin passage, an endless propelling belt is provided above and along the passage and propels the coins along the passage as it presses downward on the upper surfaces of the coins. This propelling belt is passed around pulleys provided at the entrance and exit ends of the coin passage. When a thick coin enters the space between the belt and the passage at the position of a pulley, the pulley "gives" or retreats upward to absorb the increased coin thickness. For this reason, when a thick coin thus enters at the position of the pulley, the lower span of the belt for contacting the coins is raised and separates from the coins at regions below the belt intermediate between its ends, or the belt contact pressure relative to these coins is reduced, whereby these coins are no longer driven. This has heretofore been a troublesome problem.

SUMMARY OF THE INVENTION

It is a general object of this invention to provide a coin device in which the above described problems of the prior art have been overcome, and coins of different kinds can be accurately and positively sorted without wear of the coins.

According to this invention in one aspect thereof, briefly summarized, there is provided a coin sorting device characterised by: a propelling belt for frictonally contacting the upper surfaces of coins to be sifted and propelling the same along a floor structure of a coin passage, which belt has a cross section of circular shape or a shape close thereto and is highly elastic; a passage perimeter defining structure projecting into the coin passage to be contacted by the lateral edges of coins thus propelled thereby to vary the coin travel path; coin sorting holes formed in the floor structure with specific correspondence to the perimeter defining structure, each sorting hole having two opposite lateral rims spaced apart a distance such as to permit the dropping therethrough of coins of a specific diameter. In operation each part of the propelling belt contacting a coin is subjected to an elastic twist by the varying of the coin travel path due to its contacting the perimeter defining structure and each of the thus twisted parts of the belt thereby acquires a reactive restoring torque urging that coin laterally against the perimeter defining structure, whereby the lateral edges of that coin are accurately and positively positioned in the lateral direction relative to the lateral rims of that sifting hole.

According to this invention in another aspect thereof, briefly summarized, there is provided a coin sorting device substantially of the character set forth above except that, when a coin being propelled by the propelling belt contacts at its lateral edge the perimeter defining structure and is thus caused to vary its travel path, the coin causes the belt at the part in contact therewith to deflect elastically in the direction away from the perimeter defining structure and thereby to acquire a reactive restoring force urging that coin to be pressed against the perimeter defining structure, whereby the lateral edges of the coin are accurately and positively positioned in the lateral direction relative to the lateral rims of the corresponding sorting hole.

According to this invention in a further aspect thereof, briefly summarized, there is provided a coin sorting device substantially of the above stated character except that passage perimeter defining structures are provided on opposite lateral sides of the coin passage; the lower span of the propelling belt is caused by guide roller sheaves to move in a zigzag path undulating laterally from the vicinity of one perimeter defining structure to the vicinity of the other thereby to propel the coins in a zigzag path along the coin passage; and the sifting holes are sequentially and alternately disposed contiguous to the opposite perimeter defining structures at positions corresponding to the parts thereof approached by the zigzag path, whereby the coins are pressed against said parts of the perimeter defining structures, and the lateral edges of each coin are accurately and positively positioned in the lateral direction relative to the lateral rims of the sorting hole through which that coin is to drop.

The nature, principles, and utility as well as further features of the invention will be more clearly apparent from the following detailed description with respect to preferred embodiments of the invention when read in conjunction with the accompanying drawings, throughout which like parts are designated by like reference numerals and characters.

DETAILED DESCRIPTION

Figure 1:
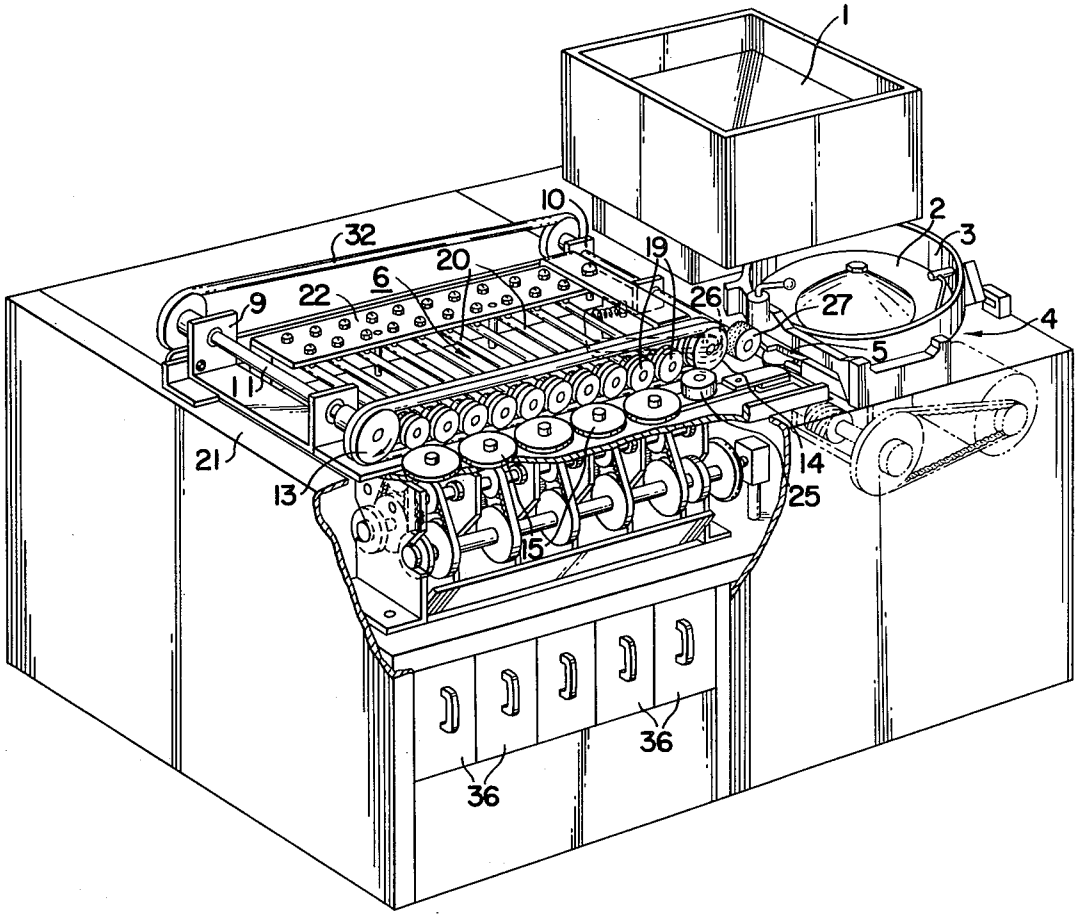
FIG. 1 is a perspective view, with a part cut away, of one example of a coin sorting machine in which the coin sorting device of the invention is provided, and as viewed from a point in front of, to the left of, and above the machine.

Referring first to FIG. 1 illustrating one example of a coin sorting machine to which this invention has been applied, the machine is provided with a hopper 1 into which a mixture of coins of several kinds are dropped and a turntable disc 2 onto which the coins thus dropped fall. As a consequence of centrifugal force due to the rotation of the turntable disc 2, the coins are alined along and against the peripheral wall 3 constituting a part of a coin feeding section 4. This coin feeding section 4 has a coin outlet 5 communicating with a coin sorting device 6 according to this invention.

Figure 2:
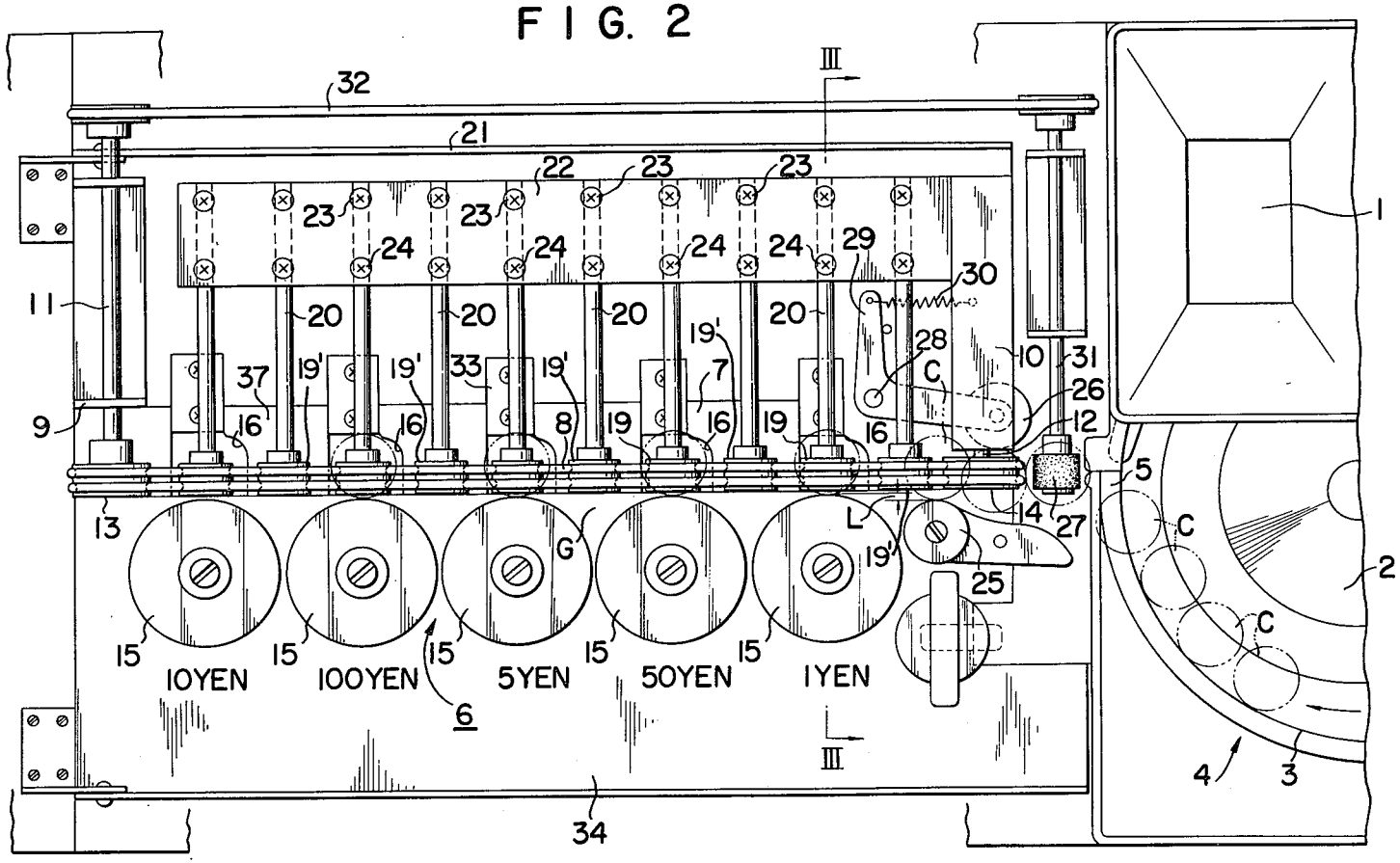
FIG. 2 is a relatively enlarged plan view of the coin sorting device of the invention and some related parts.
Figure 3:
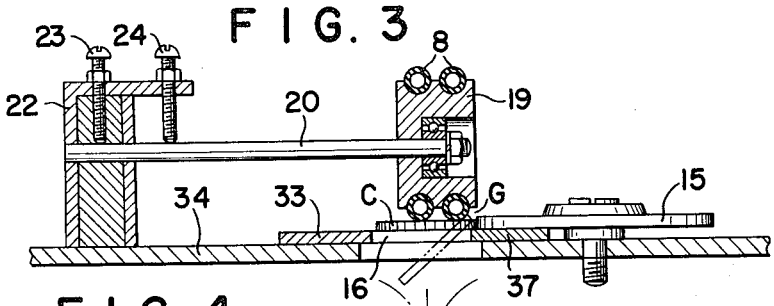
FIG. 3 is a left side elevation in vertical section taken along the plane indicated by line III—III in FIG. 2 as viewed in the direcion of the arrows.

The coin sorting device 6 in the example illustrated in the drawings is adapted to sort coins of all kinds currently used in Japan thereby to sort them into groups by kind as shown in FIG. 2. This coin sorting device 6 has a coin passage 7 contiguously following the above mentioned outlet 5 and lying in the same plane and an endless propelling belt 8 supported above and along the passage 7. The coin passage 7 has a floor in the form of a floor plate 37 mounted on a base plate 34.

The propelling belt 8 is passed around and stretched between pulleys 13 and 14 fixed to pulley shafts 11 and 12 horizontally supported by bearings 9 and 10 respectively at the downstream and upstream ends of the coin passage 7. One of the shafts, 11, is driven by a driving torque imparted thereto in the direction of the arrow. In the instant example, the propelling belt 8 comprises two belt elements disposed in mutually parallel and spacedapart relationship. Each belt element has a round tubular shape and is made of a material such as a rubber or a synthetic rubber which is soft and highly elastic and imparts great frictional force when pressed against coins. It also possesses flexibility so as to undergo flexure upon being subjected to a pressure applied to its outer peripheral surface.

On one lateral side of the coin passage 7, passage perimeter members 15, in the form of circular disks are rotatably supported in a row on a single line and constitute a perimeter defining part G of the coin passage 7. Sorting holes 16 are formed in the floor plate 37 in positions to the rear of respective disks 15. The positional relationship between the perimeter members 15 and the sorting holes 16, 16 is such that a very small ledge 18 is formed between the extreme rim of the edge 17 of each sorting hole 16 and the peripheral edge of the corresponding perimeter disk 15. In the illustrated example, the sorting holes 16 are adapted to drop, respectively, 1-yen, 50-yen, 5-yen, 100-yen, and 10-yen coins, that is, from the coin of the smallest diameter to that of largest diameter, in sequence downstream from the upstream end of the passage 7.

On one hand, belt pressing members for pressing the upper halves of the lower span of the propelling belt 8 are provided at parts of the belt confronting the sorting holes 16. These pressing members are in the form of grooved rollers 19 rotatably supported on the outer ends of respective cantilever arms 20. On opposite sides of each sorting hole 16 in the direction of the length of the belt 8 are belt holding members in the form of rollers 19' also supported by cantilever arms 20 for holding the belt 8 against lateral displacement between between the sorting holes. Each of these rollers arms 20, is fixed at its inner end by a screw 23 to an arm holding structure 22 of the machine base 21. An adjusting screw 24 is provided to abut against each roller arm 20 at a point nearer the roller 19 than the screw 23. By turning an appropriate adjusting screw 24, the vertical position of the corresponding roller 19 can be adjusted. As a result, a coin C passing along the coin passage 7 is pressed by the flexing of the propelling belt 8 itself and the deflection of the cantilever arms 20, in accordance with the thickness of the coin.

At the upstream end of the coin passage 7, there are provided a pair of gate members 25 and 26 and a feed-in roller 27. The gate members 25 and 26 in this example are in the form of rollers. One of these rollers, 25, for reference (hereinafter referred to as a "roller") has the important function of determining the path of advance of the coin C. The outer periphery of this roller 25 is disposed at a position slightly spaced a distance L from a tangential line joining the peripheral edges of the above described perimeter members 15 which are facing the coin passage 7. The roller constituting the other gate member 26 is rotatably supported on one end of a bell-crank lever 29 pivotally supported on a pivot pin 28 and is so disposed that a gap narrower than the diameter of the smallest coin is formed between this gate roller 26 and the gate roller 25 for reference as a result of the force of a tension spring 30 having one end thereof connected to the other end of the bell-crank lever 29.

In this connnection, these gate members 25 and 26 may be in a form other than rollers as long as they fulfill their respective functions.

The above described feed-in roller 27 is fixed to the front end of a horizontal shaft 31 rotatably supported on the base plate 34. This shaft 31 is driven by an endless belt 32 in the same direction as and together with the aforementioned pulley shaft 11. The feed-in roller 27 contacts the upper face of each coin delivered in a horizontal orientation from the coin feeding section 4 and forcibly feeds the coin into the space between the above described gate rollers 25 and 26. The peripheral cylindrical part of this feed-in roller 27 is made of a material such as rubber by which a large friction force can be obtained. The peripheral speed of this feed-in roller 27 is made somewhat less than the speed of the propelling belt 8 thereby to feed the coins C at suitable spaced intervals into the passage 7.

Each of the sorting holes 16 is bordered on one lateral side thereof by the aforementioned ledge 18 constituting the rim on that side and is bordered on the opposite lateral side by the edge of an adjusting plate 33, the position of which is adjustable relative to the floor plate 37 and the base plate 34. By finely adjusting the mounting position of each plate 33, the transverse width of the corresponding sorting hole 16 can be accurately set and, moreover, can be varied as desired.

Figure 6:
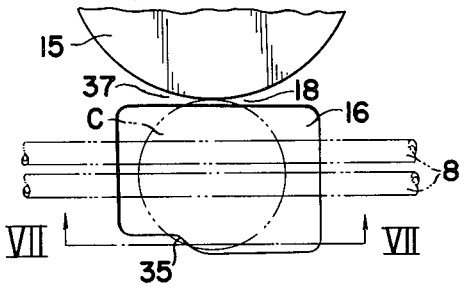
FIG. 6 is a partial plan view showing the shape of a sorting hole and the state of a coin.

Furthermore, as shown in FIG. 6, a projecting rim part 35 is formed on the rim of each sorting hole 16 near the upstream end thereof on the lateral side remote from the corresponding perimeter member 15. A coin C sent to a sorting hole 16 through which it is to drop is first supported by the ledge 18 and the the projecting rim part 35 until the coin C, in advancing further, slips off this rim part 35 to drop through the sorting hole 16.

The coins which have been thus sorted are thereafter conducted into respective containers or drawers 36, each of which receives and stores coins of only one kind.

The coin sorting machine and the coin sorting device of the above described construction according to this invention operates as follows.

Mixtures of different kinds of coins are dropped into the hopper 1 and are directed onto the turntable 2. As a result of the centrifugal force due to the rotation of the turntable 2, as described hereinbefore, the coins are forced outward and are aligned along and against the peripheral wall 3 until they are fed through the outlet 5 into the coin passage 7.

The coins thus sent into the passage 7 are fed by the feed-in roller 27 into the space between the gate members 25 and 26 and are then acted upon by the propelling belt 8 to be conveyed further one after another at certain intervals.

Figure 4:
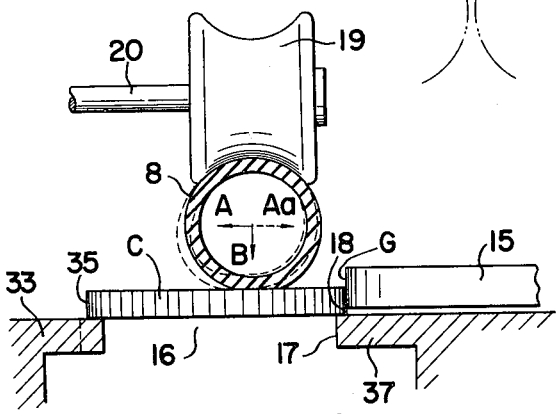
FIGS. 4 and 5 are diagrammatic elevations, partly in vertical section, showing the principle of operation of the invention.
Figure 5:
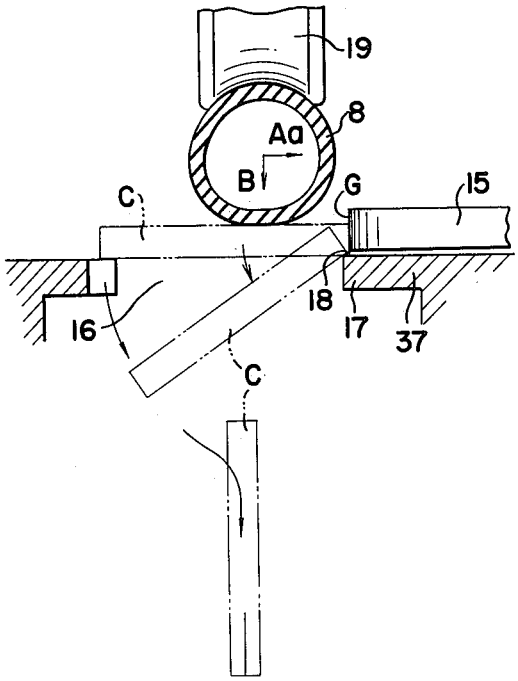

The propelling belt 8 at this time undergoes a deflection in the vertical direction in accordance with the thickness of each coin C entering into the space below the belt as indicated in FIG. 4. The elastic restoring force of the belt 8 becomes a pressing force B on the coin C as indicated in FIG. 4, whereby the belt propels the coins without slippage between the belt and the coin.

Each coin C enters the coin passage 7 under the guidance of the reference gate roller 25, passing thereby as it forces open the other gate roller 26 against the force of the spring 30. Thus, the path of advance of the coin C is determined by the gate roller 25, and, at this position the coin is acted upon by the pressing contact of the propelling belt 8 and is thus sent along the coin passage 7.

When the coin C thus fed into the coin passage 7 is a 1-yen coin, for example, and is sent to the first, or furthest upstream, sorting hole 16, the edge of the coin on one side strikes against the first passage perimeter member 15, and the coin travel path shifts over to the side opposite to the perimeter member. Since the upper half part of the propelling belt 8 is held by the grooved pressing roller 19 at this time as indicated in the enlarged view of FIG. 4, this shifting of the coin travel path causes the lower half of the propelling belt 8 to deflect in the lateral direction A to assume the elastically deformed state indicated by the broken line.

As a result, a twist is imparted locally to the propelling belt 8 to the part thereof in pressing contact with the coin C. The belt 8 is thus twisted elastically. Accordingly, the belt 8, in this twisted part thereof, exerts a restoring force in the direction Aa which is transmitted to the coin C to press the coin against the perimeter member 15. Consequently, the coin C advances along the passage 7 with its edge on one side sliding on the ledge 18 without any regulating action being imparted to the edge on the other side.

Figure 7:
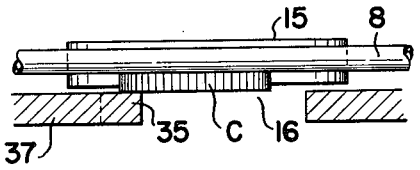
FIG. 7 is an elevation partly in vertical section taken along the plane indicated by the line VII—VII in FIG. 6 as viewed in the direction of the arrows.

Furthermore, since the coin C is pressed at its upper face by the belt 8 as indicated in FIG. 7 until it disengages from the projecting rim 35 of the solving hole 16 through which it is to drop, it advances while being held in a horizontal state. At the instant when the coin C disengages from the projecting rim 35, the edge of the coin on the side of the projecting rim 35 becomes free, whereby the coin is supported only at its opposite edge by the ledge 18 while being pressed downward by the belt 8. Consequently, the coin C is subjected not only to a moment due to its weight but also a moment due to the elastic force exerted by the belt 8 as a result of its previous vertical deflection. The coin C is thereby flipped sharply downward and is thus forcibly urged through the sorting hole 16.

As a result of this action, the coin C starts to drop on its side which has disengaged from the projecting rim 35, that is, the side opposite the ledge 18 and therefore rotates about its edge still resting on the ledge 18, assuming a substantially vertical position by the time it passes through the sorting hole 16. This action is very convenient in instances such as that wherein the coins thus dropped are to be caught between rollers for purposes such as counting.

Coins other than 1-yen coins straddle the sorting hole 16 for 1-yen coins, being supported by the ledge 18 and the opposite adjusting plate 33, and accordingly pass by this hole 16 without dropping therethrough. Each of these coins thus travels along the passage 7 until it reaches its corresponding sorting hole 16, whereupon it drops therethrough in the manner described above with respect to a 1-yen coin. The coins which have thus been dropped through their respective sorting holes 16, are counted in a suitable manner and collected in their respective containers 36

While, in the above described example, the sorting device is adapted to carry out sorting of coins of five different kinds, this invention is not thus restricted to five kinds of coins. In the case of a minimum of two kinds of coins, coins of one kind can be caused to drop through a sorting hole, while coins of the other kind can be taken out from the downstream end of the coin passage 7.

In the above described example of the coin sorting device according to this invention, perimeter members 15 are disposed in a straight row on one lateral side of the coin passage 7 thereby to form a passage perimeter defining part G, and on the opposite lateral side there is nothing whatsoever for limiting the passage width. By this structural arrangement there is no limit to the outside diameter of the coins C which can be sorted. Accordingly, even when there are coins having large diameter mixed in with the other coins, the coins can be sorted without any adverse effect whatsoever, whereby the range of application of the sorting device of this invention is greatly broadened.

In the case where the outside diameters of the coins to be sorted are limited beforehand to be within a certain range, the perimeter members 15, can be disposed in alternately staggered or zigzag arrangement. By this arrangement, when each coin C strikes the perimeter members 15 in succession, its travel path is shifted alternately to opposite lateral sides. As a result, the direction of twist of the propelling belt 8 is alternately reversed, whereby any tendency of the belt to acquire a permanent set of the twist in one direction is prevented.

Figure 8:
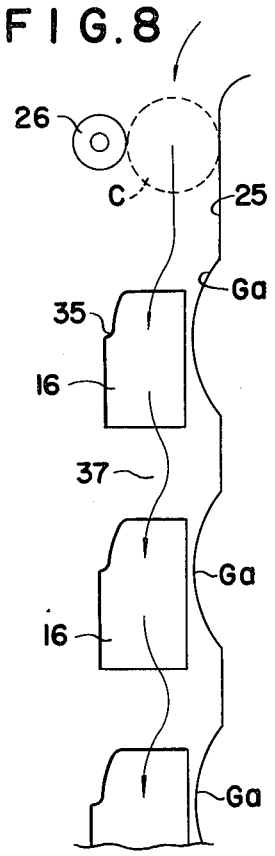
FIG. 8 is a diagrammatic plan view showing another example of a reference gate and a passage perimeter defining part of the sorting device of the invention.

In the instant example, furthermore, the perimeter members 15, 15 comprise freely-rotatable disks, but these disks may be replaced by a stationary member having a perimeter defining part Ga of wave form as shown in FIG. 8.

Figure 9:
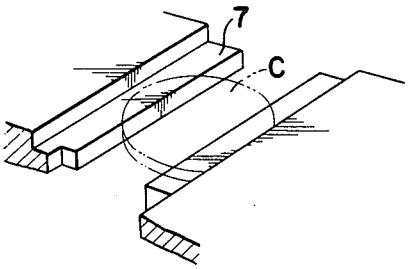
FIG. 9 is a partial perspective view showing another example of a coin passage.

The reference gate member 25, which is in the form of a freely rotatably disk in the above described example, may also be a surface contiguously joining the perimeter defining part as shown in FIG. 8. In addition, the sorting holes are not limited in form to holes as described above but may be replaced by a coin passage of a construction as indicated in FIG. 9 by which only the lateral edges of the coins are engaged by lateral ledges, and the sifting apertures are in the form of a slot of appropriately varying width between the edge faces of the lateral ledges.

Thus, this invention is characterized by the following features. The propelling belt for pressing down on the upper faces of coins and propelling them in a horizontal plane has a construction such that it readily undergoes elastic deformation such as, for example, a tubular belt or a belt of similar construction. As a consequence of the action of the reference gate member, the coins are introduced into the coin passage through which they travel along a specific path. A passage perimeter defining part is provided which projects into the coin passage to vary the travel path of the coins, and sorting holes are formed in the floor plate of the coin passage. Then, as each coin strikes against the perimeter defining part, and its travel path is forcibly varied, a twist is imparted to the propelling belt in the part against the upper face of that coin, and, as a result of the restoring force due to the twist, the coin is constantly subjected to a force which holds the coin in the correct in the correct travel path, that is, a force which presses the coin constantly against the perimeter defining part, whereby the coin travel path is maintained constant. Accordingly, when the coin passes by a sorting hole, one lateral hole, edge of the coin always passes accurately through a specific position relative to the rim on one side of the sorting hole. Therefore, the sorting holes function positively, and the sorting accuracy can be greatly increased.

Further advantageous features of the invention are as follows. Each coin is maintained in a horizontal attitude until immediately prior to the instant it drops into its sorting hole and, at the instant of dropping into that hole, it is forcibly flipped into the hole by the elastic returning force of the propelling belt. For this reason, there is no necessity of lengthening the sorting hole, whereby when the sorting device is used in a coin sorting machine for several different kinds of coins as described above, the length of the coin passage can be kept short.

In addition, since the above described high performance of the sorting device of this invention can be positively attained even when the coins are propelled at high speed, high-speed sorting becomes possible, whereby a highly efficient operation is afforded. Moreover, even when coins of different thicknesses are successively fed to the device, the differences in thickness are absorbed by deformation of the propelling belt, and the problem of slippage due to reduction in the pressure of the belt relative to a coin is solved.

Another embodiment of this invention will now be described with reference to FIGS. 10 through 13. The general layout and arrangement of the essential parts of the sorting device of this example relative to a coin sorting machine is substantially as described above with respect to the preceding example and as illustrated in FIGS. 1 and 2. In FIGS. 10 through 13, parts which are the same or equivalent to corresponding parts in FIGS. 1 through 9 are designated by like reference numerals. Since these parts have been previously described in connection with the preceding example, the detailed description thereof will not be repeated.

The coin propelling belt 8 in the instant example comprises two tubular belt elements each of which has the same physical properties as the belt element in the preceding example. The belt element in the instant example can be of tubular shape with a round cross section, or it can have any other suitable cross sectional shape such as a square or flat rectangle.

At parts of the propelling belt 8 corresponding to the sorting holes 16, there are provided belt holding members for holding the upper part of the lower span of the belt. These belt holding members, which are also positioned at parts corresponding to the perimeter members 15, are in the form of rollers $\mathbf{19}_a$. . . of smooth cylindrical shape. Interposed alternately between these rollers $\mathbf{19}_a$. . . are holding members in the form of rollers $\mathbf{19}_b$. . . provided with grooves into which the upper halves of the belt elements of the lower span of belt 8 can fit.

These rollers $\mathbf{19}_a$ and $\mathbf{19}_b$ are rotatably supported by respective cantilever arms 20, which are adjustably supported by an arm holding structure 22 and screws 23, and 24 as described hereinbefore. By adjustably turning each screw 24, the vertical height of the corresponding roller $19_a$ or $19_b$ can be adjusted. Accordingly, a coin C traveling along the coin passage 7 is pressed downward by elastic force arising from the deflection of the propelling belt 8 itself and also from the deflection of the cantilever arms 20.

The operation of coin sorting machine and the sorting device of the instant example incorporated therein is the same as that described hereinbefore up to and including the action of the reference gate roller 25, the gate roller 26, and the feed-in roller 27. Thereafter the device operates as follows.

Figure 11:
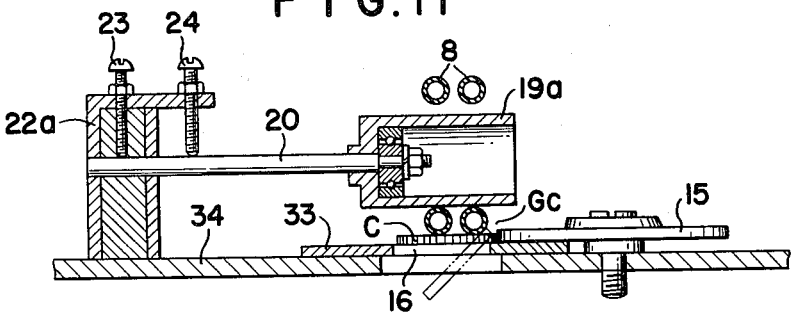
FIG. 11 is a left side elevation similar to FIG. 3 showing a cylindrical roller for pressing down on the lower span of the propelling belt and related parts in the same embodiment of the invention shown in FIG. 10.

The case where the coin C fed into the coin passage 7 is a 1-yen coin will be considered. When this coin reaches the position of the first sorting hole 16 which is for 1-yen coins, one lateral edge of the coin C strikes against the first passage perimeter member 15, and the travel path is shifted to the side opposite the perimeter member. At this time, and at this part of the device, the propelling belt 8 is deflected elastically by bending toward the side away from the perimeter member 15 since the roller $19_a$ serving as a holding member has a smooth cylindrical shape as indicated in FIG. 11. The returning force of the belt presses the coin C against the perimeter defining surface of the perimeter member 15. Consequently, the coin C advances while it is pressed against the perimeter member 15 with one lateral edge of the coin sliding on the side ledge 18 of the sorting hole 16 without being subjected to any regulation from the opposite lateral edge. Since the upper face of the coin C is held by the belt until the coin disengages from the projecting rim 35, the coin is maintained in a horizontal position as it advances.

The features of the subsequent part of the operation wherein the coin C is forcibly flipped and dropped through the sorting hole 16 is the same as that described hereinbefore.

Figure 10:
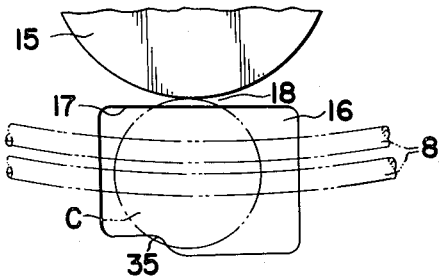
FIG. 10 is a partial plan view showing a sorting hole, a coin, a perimeter member, and deflected belt elements in another embodiment of the invention.

In the case where the passage perimeter members 15 are freely rotatably disks as shown in FIGS. 10 and 11, these perimeter members rotate as the coins C travel past. For this reason, the friction between the peripheral surface of each coin C and the peripheral surface of a perimeter member 15 is very small, and there is almost no abrasion of the coins C and the perimeter members 15. As a result, troublesome occurrences such as formation of abraded particles, wear of coins C, and deviations in the dimensions of the perimeter members are prevented, and, moreover, the resistance to the traveling movement of the coins is small. For this reason, slipping between the belt 8 and the coins C does not occur, and erroneous coin sorting due to defective operation such as irregularity in the coin feed spacing, collisions between coins in the coin passage, and overshooting of coins past their proper sorting holes because of excessive pushing or clogging of coins is prevented.

Figure 12:
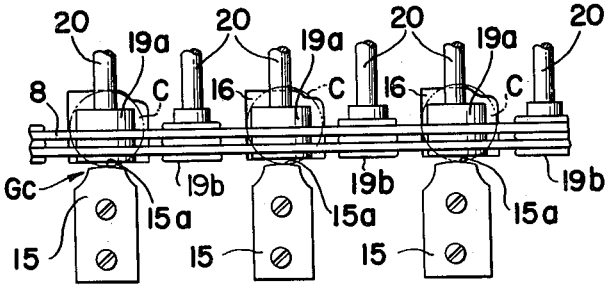
FIGS. 12 and 13 are partial plan views respectively showing modifications of the same embodiment.
Figure 13:
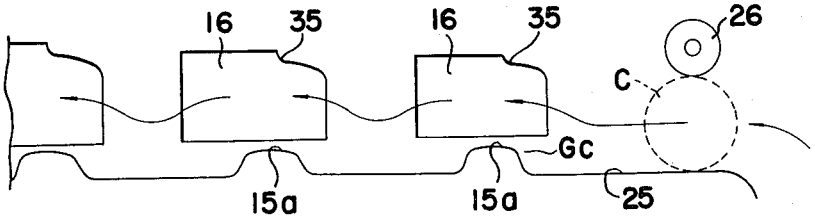

Furthermore, in the case where fixed passage perimeter members 15 are provided as shown in FIGS. 12 and 13, the time during which they are in frictional contact with the coins C can be made very short by making the length of the perimeter face 15*a* of these perimeter members less than the diameter of the coins. Thus, in this case, also, undesirable occurrences such as wear and slipping can be almost completely prevented.

In this example, also, the reference gate member 25 can be formed contiguously with the passage perimeter defining part Gc as shown in FIG. 13. Furthermore, the sorting holes 16 are not limited in shape to those illustrated but may be an opening in a coin passage having a construction in which only the opposite lateral edges of the coins C are supported by the opening rims, the width between which is varied to accomplish sorting.

A further embodiment of this invention will now be described with reference to FIGS. 14 through 17. The coin passage 7*a* of this third example of the coin sorting device according to the invention has first and second passage side walls 41 and 42 disposed in mutually facing positions and defining the lateral perimeters of the passage 7*a*. The coin passage 7*a* also has a floor surface 43 over which coins C slide, propelled by an endless propelling belt 44 supported above and along the passage.

The propelling belt 44, which has a tubular shape with an annular cross section in the unstressed state and has the same physical properties as the propelling belts in the preceding examples, is passed around and supported by pulleys 45 and 46 respectively supported at the upstream and downstream end parts of the coin passage 7*a* by respective horizontal shafts as in the preceding examples. The lower span 44*a* of this belt 44 is spaced from the passage floor surface 43 by a gap such that the belt can propel the thinnest coin to be sorted and is adapted to travel along and over the passage $7_a$ in a zigzag or undulating path as described hereinafter between the passage side walls 41 and 42.

Figure 14:
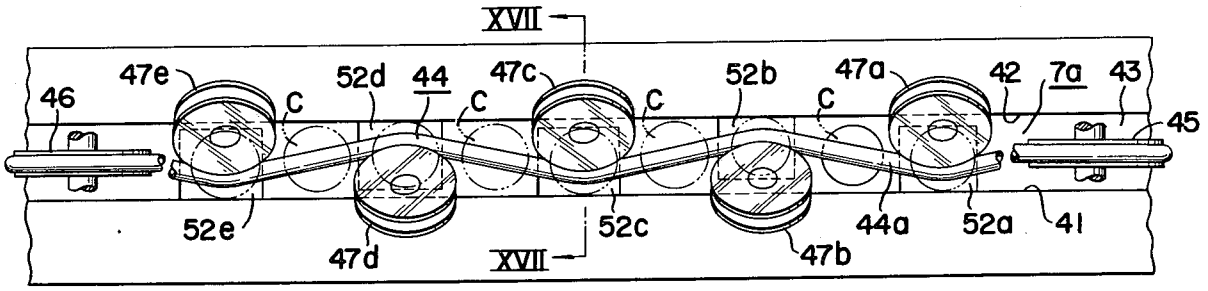
FIG. 14 is a plan view showing still another example of the coin sorting device according to the invention.
Figure 15:
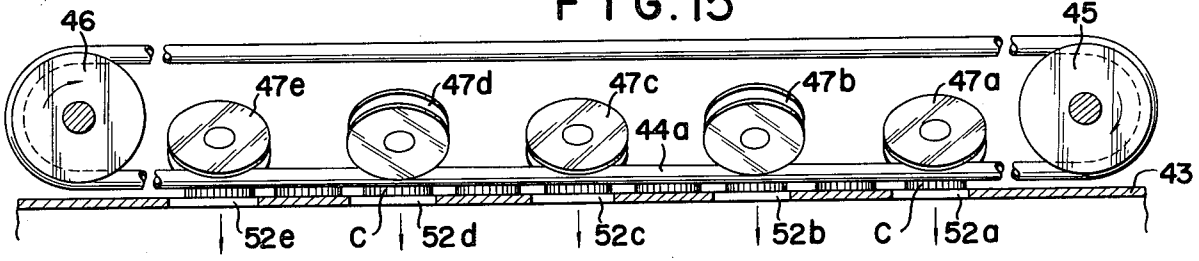
FIG. 15 is an elevation orthogonally corresponding to FIG. 15.
Figure 16:
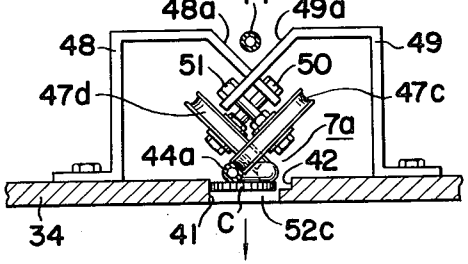
FIG. 16 is an elevation in section taken along the plane indicated by line XVII — XVII in FIG. 14 as viewed in the direction of the arrows.

The lower span $44_a$ of the propelling belt 44 is caused to travel in this zigzag path by a plurality of guide roller sheaves $47_a$, $47_b$, . . . $47_e$ disposed in a row above the coin passage $7_a$ and alternately having different mounting angles as shown in FIGS. 14, 15, and 16. The lower span $44_a$ of the belt is fitted in the grooves of the roller sheaves $47_a$ through $47_e$, and, at the parts thus engaged by the roller sheaves, alternately approaches the passage side walls 41 and 42 as closely as possible, thereby being caused to travel in a zigzag or undulating path.

The guide roller sheaves $47_b$, and $47_d$ are rotatably supported on the lower ends of respective shafts 50 fixed at their upper ends to the edge part of a bent flange $48_a$ of a frame 48 fixed to the base plate 34 described hereinbefore along one side of the passage $7_a$. Similarly, the roller sheaves $47_a$, $47_c$, and $47_e$ are rotatably supported on the lower ends of respective shafts 51 fixed at their upper ends to the edge part of a bent flange $49_a$ of a frame 49 also fixed to the base plate 34 but on the opposite side of the passage $7_a$. The roller sheaves $47_b$ and $47_d$ are thus supported so as to lie in a plane inclined at an angle of approximately 45 degrees relative to the horizontal and passing through or close by the passage side wall 42. The roller sheaves $47_a$, $47_c$ and $47_e$ are thus supported to lie in a plane inclined at the same angle of approximately 45 degrees relative to the horizontal and passing through or close by the passage side wall 41. The lower parts of the grooved rims of the sheaves $47_b$ and $47_d$ thus supported and engaging the belt 44 are thereby disposed near the passage side wall 42, while those of the sheaves $47_a$, $47_c$, and $47_e$ are disposed near the passage side wall 41.

The above described frames 48 and 49 are shaped to clear the upper span of the propelling belt 44.

Along the coin passage 7*a* and in the passage floor surface 43, sorting holes $52_a$, $52_b$, . . . $53_e$ are formed at positions respectively confronting the guide roller sheaves $47_a$, $47_b$, . . . $47_e$, these sorting holes being respectively adapted to sort coins from those of the smallest diameter to those of the largest diameter in sequence from the upstream end to the downstream end of the coin passage $7_a$. These sorting holes are alternately offset from the passage centerline toward opposite side walls of the coin passage at the corresponding roller sheaves where the propelling belt 44 approaches the side walls. More specifically, the sorting holes $52_a$, $52_c$, and $52_e$ are offset toward the passage side wall 41, which constitutes the reference rim on one side of these sorting holes, while the sorting holes $52_b$ and $52_d$ are offset toward the side wall 42, which constitutes the reference rim on one side of these sorting holes.

This third example of the coin sorting device having the above described construction operates as follows.

When a mixture of coins of several different kinds are fed successively by a mechanism as described hereinbefore into the coin passage $7_a$ from its upstream end, the lower span $44_a$ of the propelling belt 44 comes into pressing contact with the upper face of each coin C to propel the coin along the passage. In this case, even when there are differences in the thicknesses of the coins, these differences are absorbed by vertical deflections or deformations of the lower span $44_a$ of the belt 44 since it is held by the guide roller sheaves $47_a$ through $47_c$, whereby there is no possibility of the lower span $44_a$ being raised relative to other thin coins to cause slipping between these coins and the belt and failure to properly propel these coins.

Figure 17:
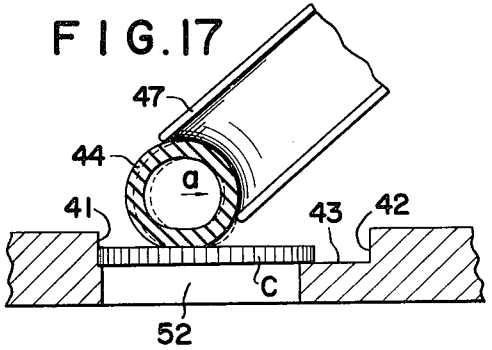
FIG. 17 is an enlarged elevation, in vertical section, indicating a state of operation of the coin sorting device illustrated in FIGS. 15, 16, and 17.

A coin C thus propelled by the lower span $44_a$ of the belt 44 from the upstream end of the coin passage $7_a$ is caused to travel in a path bent by the first guide roller sheave $47_a$, and, when it approaches the first sorting hole $52_a$, the peripheral edge of the coin C strikes and is pressed against the first passage wall 41. As a consequence of this contact, the coin C cannot move laterally any further in spite of the oblique travel path of the belt 44. For this reason, the part of the lower span $44_a$ of the belt 44 is pressing contact with the coin C is subjected to a reactive force in the direction of arrow *a* as shown in FIG. 17 and consequently is elastically deformed as indicated by the broken line. As a result, a twist is imparted to the belt 44 at this part, and the belt exerts a corresponding elastic restoring force on the coin C in the direction opposite the direction of arrow *a*, which restoring force acts to press the peripheral edge of coin C against the first passage side wall 41. Therfore, the coin C is caused to advance along the coin passage $7_a$ while it is in intimate contact with the first passage side wall 41.

When the coin C thus sent reaches the first sorting hole $52_a$, the lateral edges of the coin travel accurately in a transverse position relative to the lateral rims of the first sorting hole $52_a$ since these rims of this sorting hole have a definite positional relationship relative to the first passage side wall 41. In the case where this coin C is a coin having a diameter such that it can drop through this first sorting hole $52_a$, when the rear edge of the coin slides off the upstream rim of this sorting hole and the lateral edges of the coin are positioned between the lateral rims of the sorting hole, the coin is forcibly dropped through the sorting hole by the downward elastic restoring force due to the above mentioned deformation of the belt 44.

A coin C which does not drop through the first sorting hole $52_a$ merely passes by above this first sorting hole and is caused by the zigzag travel of the lower span $44_a$ of the 44 to be pressed against the second passage side wall 42 on the opposite side of the passage $7_a$, thus reaching the second sorting hole $52_b$. If this coin C is of the kind to be sorted by this sorting hole $52_b$, it is dropped through this hole in the same manner as described above with respect to the first sorting hole $52_a$.

The sorting operation thereafter proceeds successively in the same manner, coins of larger diameter being thus sorted in the succeeding sorting holes $52_c$, $52_d$, and $52_e$.

While a propelling belt 44 having a hollow tubular construction of annular cross section such as that in the above described example has been found to be the most desirable, the invention is not necessarily limited to such construction, any construction other than a hollow construction being practical provided that it has an elastic property by which it can undergo elastic deflection or deformation of the same effectiveness as that of a hollow construction.

Thus, in the example of the invention as described above, a propelling belt having an annular cross section having great elasticity is disposed above the coin passage, and the lower span of this belt is caused to travel along an undulating or zigzag path as it operates to propel coins in succession along the coin passage, the zigzag path being fixed in space and lying in a horizontal plane. At the outer sides of the bends in this zigzag path, the coin passage side walls alternately define reference perimeters for respective sorting holes. At each of these sorting holes, a twist in the propelling belt is utilized to press a coin against the corresponding passage side wall defining the reference perimeter thereby to always position the coin accurately relative to the corresponding sorting hole. Accordingly, the accuracy of coin sorting by means of the sorting holes can be greatly increased, whereby the reliability of the coin sorting machine can be greatly improved.

Furthermore, since the direction of twist in the propelling belt traveling in the zigzag path is alternately reversed at succeeding bends in that path, any tendency of the belt to acquire a residual set or deformation is prevented, whereby the service life of the belt is prolonged. In addition, since the propelling belt has great elasticity, it can simultaneously propel coins of different thicknesses without slippage between the belt in effect absorbs the differences in thickness and presses on the thin coins with ample pressure.

I claim:

1. A coin sorting device for use in a coin sorting machine wherein a mixture of several kinds of coins are sorted and classified, said coin sorting device comprising a coin passage having a floor and upstream and downstream ends for aligning the coins fed thereinto in a row; at least one coin propelling belt having large elasticity and a frictional surface for engaging the coins and propelling them along said coin passage from the upstream end to the downstream end thereof; said coin passage floor having sorting hole defining means defining sorting holes at intervals along said coin passage which holes have successively larger dimensions transversely of the coin passage through which coins of different diameters can pass as said coins are propelled past sorting holes with lateral dimensions corresponding to the diameters of the coins; a coin passage lateral perimeter defining means projecting laterally into the coin passage at each sorting hole to a point just short of the edge of the corresponding sorting hole for engaging the peripheral edges of the coins being propelled along the coin passage and displacing said coins in a direction transverse to the coin propelling direction, thereby to cause elastic lateral deformation of the coin propelling belt and to position said coins at positions for passing through corresponding sorting holes; belt holding members on opposite sides of each sorting hole in the direction of the length of the belt for holding the coin propelling belt against displacement laterally from the normal position at last between the sorting holes; and belt pressing members provided at points along the coin passage between said belt members and adjacent said sorting holes for pressing said belt downward at respective positions of the sorting holes; whereby the coin propelling belt is deformed when the coins are displaced laterally by the perimeter defining means due to the friction between the coin propelling belt and the coins and the restoration force generated in the coin propelling belt due to the deformation urges said coins toward said perimeter defining means and said coins are forcedly urged through the corresponding sorting hole by the force of the coin propelling belt on the coins urging the coins against the bottom of the coin passage by the action of the belt pressing members.

2. The coin sorting device as claimed in claim 1, in which said perimeter defining means comprises a plurality of freely rotatable circular plates, one positioned adjacent each sorting hole, and which are rotated by and synchronously with the coins being propelled along said coin passage by the propelling belt.

3. The coin sorting device as claimed in claim 1, in which the coin propelling belt has a circular cross-section for being twisted or deformed when a coin beneath and being propelled by said coin propelling belt is laterally shifted by the perimeter defining means.

4. The coin sorting device as claimed in claim 3, in which the coin propelling belt is tubular for being deformed in a direction for pressing downward on the coins being propelled, whereby the restoration force caused by said deformation urges the coins to pass positively through the corresponding sorting holes.

5. The coin sorting device as claimed in claim 1, further comprising a centrifugal turntable for feeding coins of different sizes one by one into the coin passage, and a feed-in roller provided above the upstream end of the coin passage for engaging and advancing the coins fed from said centrifugal turntable toward a position below the propelling belt, peripheral velocity of said feed-in roller being slower than that of the propelling belt.

6. The coin sorting device as claimed in claim 1, in which said sorting hole defining means has an inwardly projecting rim part at the rim of the sorting hole at a position toward the upstream end of the coin passage and on the side remote from the corresponding perimeter member, whereby only after the edge of the coin passes said rim part said coin is the coin forcibly urged through said sorting hole by the coin propelling belt.

7. A coin sorting device comprising:

a coin passage structure defining a coin passage with upstream and downstream ends and having a floor structure having formed therein, in spaced-apart sequence, a plurality of sorting holes for respectively permitting passage therethrough of coins having different diameters and propelled along said coin passage, and further having first and second passage side walls disposed on opposite lateral sides of said floor structure for defining lateral reference perimeters of the coin passage, each sorting hole having two opposite lateral rims spaced a specific distance for passing coins of a specific diameter corresponding to that sorting hole, said sorting holes being disposed successively along the coin passage floor structure from the upstream end in the order of progressively increasing size from a sorting hole for coins of the smallest diameter to a sorting hole for coins of the largest diameter and being positioned in a staggered arrangement wherein the sorting holes are alternately offset in opposite lateral directions and are alternately contiguous to said passage side walls; a propelling belt having great elasticity and having a span substantially parallel to and spaced from the coin passage floor structure a distance less than the thickness of the thinnest of the coins to be sorted;

guide roller sheaves engaged with said propelling belt for guiding the belt in a zigzag path the alternate bends of which closely adjacent to the opposite passage side walls at the positions of the sorting holes respectively contiguous thereto, whereby the coins are propelled in a zigzag path closely corresponding to said path of the propelling belt thereby to strike alternately against the opposite side walls, parts of the propelling belt propelling the coins being elastically twisted when the coin engage the side walls for producing in the propelling belt a reactive, restoring torque urging the coins laterally against the side walls against which they have engaged, whereby the edges of the coins are accurately and positively positioned relative to the lateral rims of the sorting holes.

* * * * *